US006625821B2

(12) United States Patent
Lhoste

(10) Patent No.: US 6,625,821 B2
(45) Date of Patent: Sep. 30, 2003

(54) DISPENSER FOR ADDING A CLEANING AND/OR DEODORIZING PRODUCT TO A TOILET BOWL

(75) Inventor: Jean-François Lhoste, Le Coudray (FR)

(73) Assignee: Reckitt Benckiser France, Massy Cedex (FR)

( * ) Notice: Subject to any disclaimer, the term of this patent is extended or adjusted under 35 U.S.C. 154(b) by 0 days.

(21) Appl. No.: 10/188,948

(22) Filed: Jul. 3, 2002

(65) Prior Publication Data

US 2003/0106143 A1 Jun. 12, 2003

Related U.S. Application Data

(63) Continuation of application No. PCT/GB01/00084, filed on Jan. 10, 2001.

(30) Foreign Application Priority Data

Jan. 10, 2000 (GB) ..... 0000356

(51) Int. Cl.[7] ..... E03D 9/02
(52) U.S. Cl. ..... 4/231; 4/223
(58) Field of Search ..... 4/231, 229, 223, 4/222

(56) References Cited

U.S. PATENT DOCUMENTS

| | | | | | |
|---|---|---|---|---|---|
| 1,269,088 | A | * | 6/1918 | Kelly | 4/231 |
| 3,766,576 | A | * | 10/1973 | Ancel | 4/231 |
| RE32,017 | E | * | 11/1985 | Hautmann et al. | 4/231 |
| 4,777,670 | A | * | 10/1988 | Klinkhammer et al. | 4/231 |
| 4,813,084 | A | * | 3/1989 | Buecheler et al. | 4/231 |
| 4,896,382 | A | | 1/1990 | Sokol et al. | |
| 6,510,561 | B1 | * | 1/2003 | Hammond et al. | 4/231 |

FOREIGN PATENT DOCUMENTS

| | | |
|---|---|---|
| DE | 197 41 283 A1 | 4/1999 |
| EP | 1 046 756 A1 | 10/2000 |
| FR | 2 430 486 A1 | 2/1980 |
| GB | 2 339 209 A | 1/2000 |
| WO | WO 99/66139 A1 | 12/1999 |

* cited by examiner

*Primary Examiner*—Gregory Huson
*Assistant Examiner*—Huyen Le
(74) *Attorney, Agent, or Firm*—Akin, Gump, Strauss, Hauer & Feld, L.L.P.

(57) ABSTRACT

A dispenser is provided for dispensing cleaning and deodorizing products for toilets, particularly for hanging over the rim of a toilet bowl. The dispenser comprises a location device and a refill cartridge for storing product to be dispensed. The location device comprises an attachment member for attaching the device to a toilet bowl and an element for receiving and supporting the refill cartridge. The refill cartridge comprises a container which, prior to use, is. sealed with a removable lid, wherein removal of the lid exposes at least a portion of the product contained in the container for dispensing.

7 Claims, 2 Drawing Sheets

DISPENSER FOR ADDING A CLEANING AND/OR DEODORIZING PRODUCT TO A TOILET BOWL

CROSS-REFERENCE TO RELATED APPLICATIONS

This application is a continuation of International Patent Application No. PCT/GB01/00084, filed Jan. 10, 2001, which was published in the English language on July 19, 2001 under International Publication No. WO 01/51720 A1, and the disclosure of which is incorporated herein by reference.

BACKGROUND OF THE INVENTION

This invention relates to improvements in or relating to dispensing systems incorporating containers dispensing cleaning and/or deodorizing products which are hung over the rim of a toilet bowl.

A very large number of such dispensing containers is already known for compositions containing constituents such as anti-microbial agents, perfumes, bleaching agents, colorants, and/or surface active agents for use in treating the water in toilet bowls. Ordinarily, the compositions are located in cage-like containers suspended near the rim of a toilet bowl in a position where, on each occasion the bowl is flushed, the flushing water enters the container and contacts the composition to entrain some of the composition before flowing into the lower part of the bowl. Thus, the water remaining in the bowl, after flushing, includes some of the composition which disinfects or otherwise treats the water and the surfaces of the bowl.

Conventionally, such compositions have been in the form of coherent self-supporting blocks. However, more recently, compositions in the form of gels and liquids have been proposed. These compositions have to have a relatively high viscosity to ensure that a substantial proportion of the composition remains in the container after each flush. During flushing, water enters the container and dilutes a portion of the composition to form a relatively low viscosity liquid, which can be washed out of the container with the flush water and flow into the toilet bowl.

During use, the amount of the composition remaining in the container gradually reduces, and eventually it is necessary to renew the composition. In the case where the composition is in the form of a solid block, a replacement block can be fairly easily placed in the container. However, many of the known dispensing containers for viscous gels are refilled from a bottle or pouch from which the gel is squeezed into the container. These all have the same disadvantages in that the gel is difficult to expel cleanly and easily. The nature of the gel compositions is such that they are unpleasant to handle and highly odoriferous in concentration. There is a further difficulty in getting all of the gel out of such refill bottles or pouches. As the gel is so highly viscous it sticks to the walls, and the wastage can be as high as 20%, depending on the composition formula.

BRIEF SUMMARY OF THE INVENTION

It is therefore an object of the present invention to provide a system which overcomes these disadvantages by enabling the container storing the composition to be replaced.

According to the present invention, there is provided a dispenser for dispensing cleaning and/or deodorizing products for toilets, comprising a location device and a refill cartridge for storing product to be dispensed, the location device comprising an attachment member for attaching the dispenser to a toilet bowl and an element for supporting the refill cartridge, such that the refill cartridge is suspended below the location device. The refill cartridge comprises a container having a removable lid, such that removal of the lid exposes at least a portion of the product contained in the container for dispensing. A base of the container is provided with at least one drainage hole which, prior to use, is sealed with a frangible element, which is breakable to open a drainage aperture.

Preferably the container comprises a plurality of walls defining an open mouth, and the receiving and supporting elements of the location device comprise a closure member for closing the container mouth in which are provided a plurality of apertures.

Underneath the removable lid, the container is preferably provided with a closure member in which are provided a plurality of apertures, and the receiving and supporting elements of the location device support at least a pair of opposing edges of the cartridge.

Preferably, the removable lid comprises a peelable laminate.

The means for attaching the device to a toilet bowl preferably comprises a hook.

Preferably, the receiving and supporting elements of the location device have a peripheral edge which is angled downwardly to form a lip and, on an inner surface of the lip, are catches for retaining an outwardly projecting flange provided on the refill cartridge.

Preferably, the receiving and supporting elements of the location device have an opposing pair of edges which are provided with U-shaped runners, for receiving and supporting outwardly projecting flanges provided on the refill cartridge.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
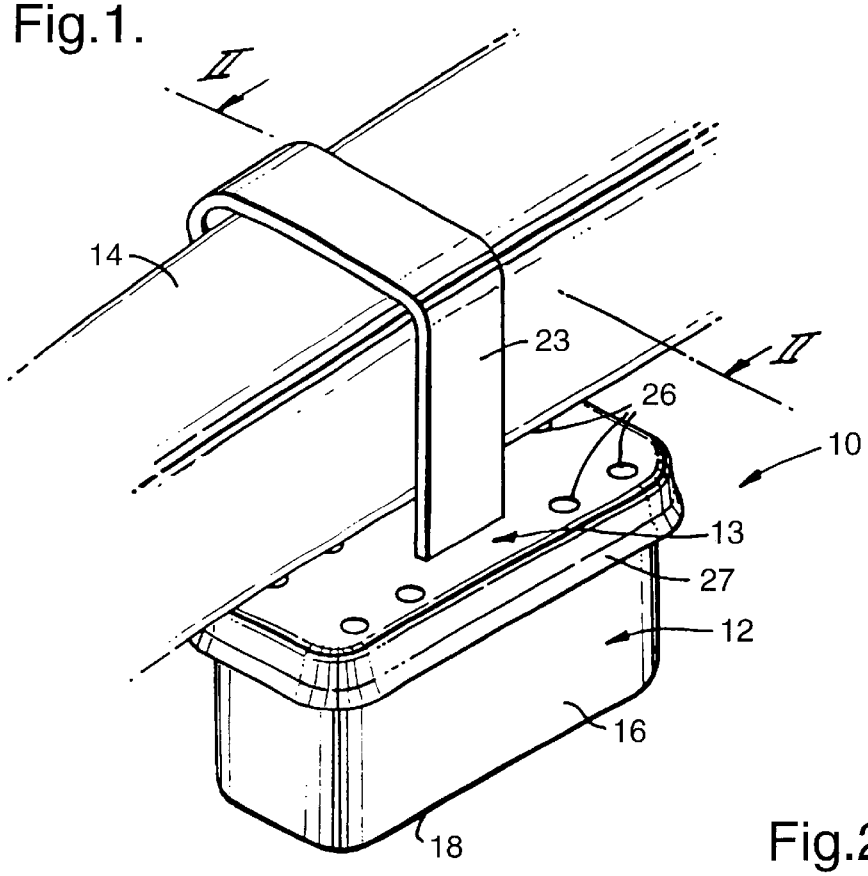
FIG. 1 is perspective view of a dispenser according to the present invention suspended over a section of the rim of a toilet bowl.

Referring to FIG. 1 there is shown a dispenser 10 for use in dispensing a water soluble water treatment and/or deodorizing composition 11 (see FIG. 2), preferably in the form of a viscous gel. However, it should be noted that the dispenser could be used for liquid or solid compositions. The dispenser 10 has two main component parts. These comprise a disposable refill cartridge in the form of a container 12 for storing the composition 11 and a location device 13 for locating the container 12 under the rim 14 of a toilet bowl 15 in the path of the water outlets. The container 12 and location device 13 are preferably made from a plastic material.

Figure 2:
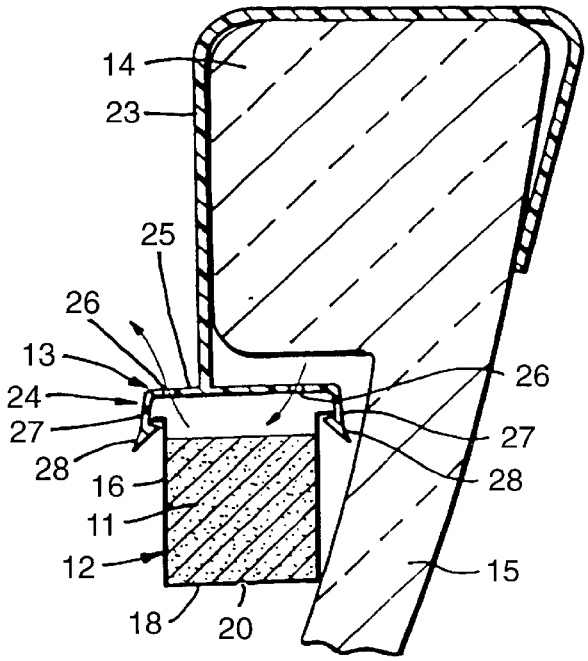
FIG. 2 is a cross-sectional side elevation of the dispenser of FIG. 1; taken on line II—II.
Figure 3:
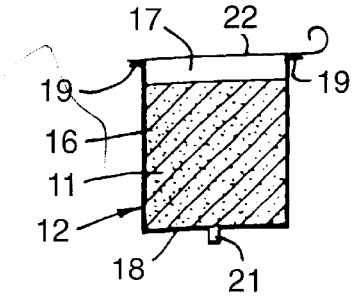
FIG. 3 is a cross-sectional side elevation of a refill container for the dispenser of FIG. 1: also taken on the line II—II.

The container 12 can be in any appropriate shape, as long as it defines a chamber for receiving the composition 11 and has one or more side walls 16 defining an open mouth 17 (see FIG. 3). In the embodiments shown in FIGS. 1 and 2, the container 12 is substantially rectangular, with rounded corners and a flat base 18. At their upper edges, which define the open mouth 17, the side walls 16 are provided with a flange or detent 19. This may be by an outward angling of the upper edges of the side walls 16 or by additional protuberances. In the base 18 of the container is a small drainage aperture 20.

In a "storage" condition, the drainage aperture 20 is sealed by a plug 21. The plug can either be wholly removable or be provided in the form of a frangible pin, which can be broken off to open the drainage aperture 20. The container mouth 17 is sealed with a removable lid 22. This may be in the form of an adhesive plastic laminate or foil, which can be peeled away, or any appropriate cover or lid.

The location device 13 comprises a hook 23, or other appropriate element for attaching the device 13 to the rim 14 of the toilet bowl 15, so that it lies in the path of the water outlet(s). The free end of the hook 23 clips around the outside of the rim 14, while at the opposing end is a support closure member 24 which, in use, retains the container 12 in position and, in one embodiment, closes the mouth 17 of the container 12. In the latter embodiment the closure member 24 has a substantially planar portion 25 in which are located a plurality of ports 26. In the embodiment of the invention as shown in FIGS. 1 and 2, the peripheral edge of the closure member 24 is angled downwardly to form a lip 27 and a catch (es) 28 provided on an inner surface of the lip 27.

To prepare the dispenser 10 for use, the lid 22 is first peeled off, or otherwise removed, from the container 12. The mouth 17 of the container 12 is pushed upwardly inside the lip 27 of the closure member 24 until the flange or detent 19 is forced past the catch (es) 28 and retained securely behind them. The container 12 is thereby held in position by the closure member 24, which also covers the open mouth 17. The dispenser 10 is subsequently suspended in position from the rim 14 of the toilet bowl 15 by use of the hook 23, and the drainage aperture 20 is unplugged.

During flushing, water will flood into the container 12 through the ports 26 in the closure member 24. As the water comes into contact with the composition 11, it dilutes or dissolves a portion thereof. As the flushing action continues, the water, with the diluted or dissolved part of the composition, floods out of the ports 26 and is carried down into the toilet bowl 15, where it carries out a cleaning and/or disinfecting action. Between flushes, the composition 11 can release its fragrance via the ports to maintain a pleasant smell in the region of the toilet. Any excess water remaining in the container 12 after flushing is completed drains out through the drainage aperture 20.

When the composition 11 in the container 12 has been exhausted, the container 12 is detached by squeezing the container side walls 16 to release the flange or detent 19 and can be replaced by a new ready-filled container.

Figure 4:
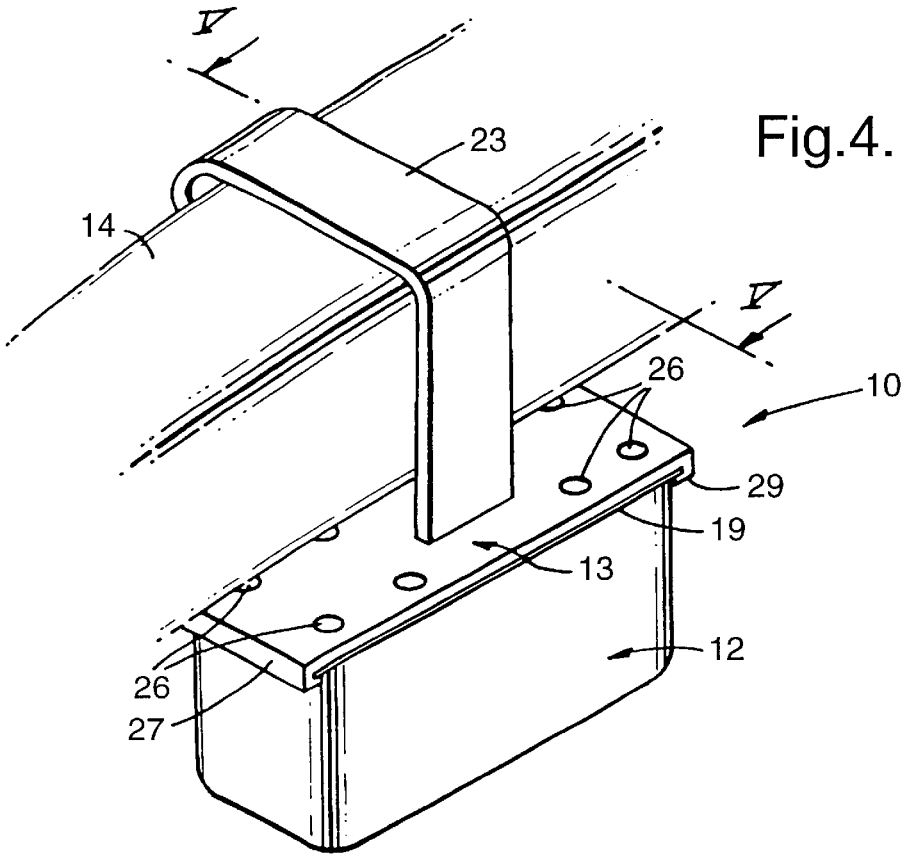
FIG. 4 is a perspective view of an alternative dispenser according to the present invention.
Figure 5:
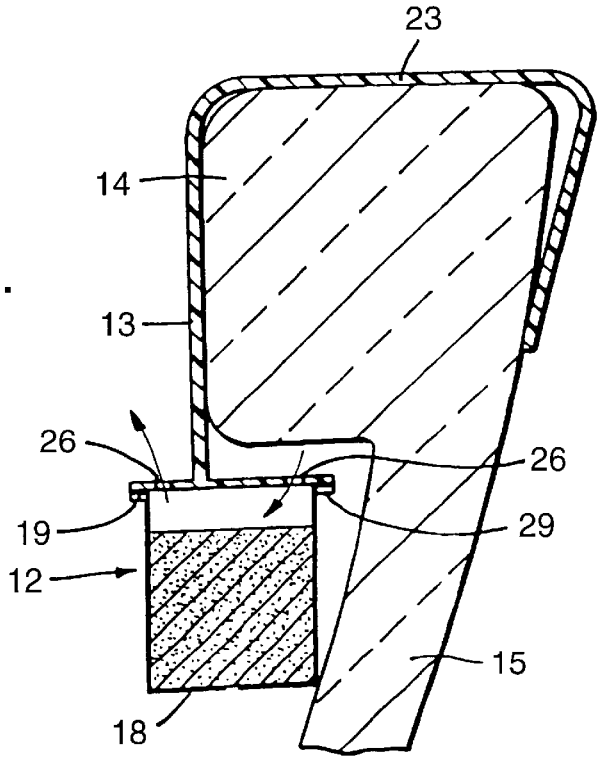
FIG. 5 is a cross-sectional side elevation of the dispenser of FIG. 4 ; taken on line V—V.

In a second embodiment of the invention, as shown in FIGS. 4 and 5, the attachment of the container 12 to the closure member 24 is modified. In this embodiment, only an opposing pair of edges of the closure member 24 is angled downwardly and inwardly to provide a pair of opposing, substantially U-shaped channels 29. The container 12 can be slid into and out of the channels 29, supported therein by means of the flange or detent 19.

In an alternate embodiment, not shown, the support member 24 comprises a frame for supporting the container 12 only, but not closing the mouth thereof. The container 12 has, beneath the removable lid 22, a permanent closure in which apertures are provided to allow the ingress of water.

A dispenser according to the present invention is advantageous in that it is significantly easier to refresh than the prior art systems. All that is required is that the lid 22 be removed from the refill-cartridge (container 12), which is then secured into position, as compared with the squeezing of a bottle or pouch to insert the gel into an orifice. Further advantages lie in that the wastage of gel known from the prior art systems is abolished, and the component parts of the dispenser are simple and easy to manufacture using well-known technology.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A dispenser for dispensing cleaning and/or deodorizing products for toilets, the dispenser comprising a location device and a refill cartridge for storing product to be dispensed, the location device comprising an attachment member for attaching the dispenser to a toilet bowl and an element for receiving and supporting the refill cartridge, such that the refill cartridge is suspended below the location device, the refill cartridge comprising a container which, prior to use, is sealed with a removable lid, such that removal of the lid exposes at least a portion of the product contained in the container for dispensing, wherein a base of the container is provided with at least one water drainage hole which, prior to use, is sealed with a frangible element, which is breakable to open a drainage aperture.

2. The dispenser as claimed in claim 1, wherein the container comprises a plurality of walls defining an open mouth and the receiving and supporting element of the location device comprises a closure member for closing the container mouth, the closure member having a plurality of apertures.

3. The dispenser as claimed in claim 1, wherein, underneath the removable lid, the container is provided with a closure member having a plurality of apertures, and the receiving and supporting element of the location device supports at least a pair of opposing edges of the cartridge.

4. The dispenser as claimed in claim 1, wherein the removable lid comprises a peelable laminate.

5. The dispenser as claimed in claim 1, wherein the attachment member comprises a hook.

6. The dispenser as claimed in claim 1, wherein the receiving and supporting element of the location device has a peripheral edge which is angled downwardly to form a lip, and, on an inner surface of the lip, a catch is provided for retaining an outwardly projecting flange provided on the refill cartridge.

7. The dispenser as claimed in claim 1, wherein the receiving and supporting element of the location device has an opposing pair of edges which are provided with U-shaped runners for receiving and supporting an outwardly projecting flange provided on the refill cartridge.

* * * * *